United States Patent [19]

Le Donne

[11] 4,266,825

[45] May 12, 1981

[54] MOUNTS FOR ATTACHMENT OF DEVICES TO WHEELCHAIRS

[76] Inventor: Robert Le Donne, 447 Oakdale, Chicago, Ill. 60657

[21] Appl. No.: 51,435

[22] Filed: Jun. 25, 1979

[51] Int. Cl.[3] ..... A47C 7/62

[52] U.S. Cl. ..... 297/194; 297/153; 248/168; 248/187

[58] Field of Search ..... 248/168, 187, 464, 103, 248/226.4, 188.9; 297/194, 153; 5/507, 503

[56] References Cited

U.S. PATENT DOCUMENTS

| | | | |
|---|---|---|---|
| 563,496 | 7/1896 | Macklin | 248/188.9 X |
| 1,247,144 | 11/1917 | Petermann | 248/187 X |
| 1,445,918 | 2/1923 | Sterling | 248/226.4 |
| 1,719,614 | 7/1929 | McIntosh | 5/507 X |
| 1,886,112 | 11/1932 | Luarde | 248/188.9 |
| 3,097,884 | 7/1963 | Alford | 297/153 |
| 3,208,698 | 9/1965 | Samhammer | 248/188.9 |
| 3,408,032 | 10/1968 | Francis | 297/194 |
| 3,475,052 | 10/1969 | Kaposi | 297/153 |
| 3,515,429 | 6/1970 | Bollinger | 297/153 |
| 3,606,450 | 9/1971 | Sedgwick | 297/153 |

FOREIGN PATENT DOCUMENTS

| | | | |
|---|---|---|---|
| 47532 | 2/1937 | France | 297/153 |

*Primary Examiner*—Francis K. Zugel

*Attorney, Agent, or Firm*—Laff, Whitesel & Rockman

[57] ABSTRACT

A mounting device of the described type may be viewed as being somewhat similar to a camera tripod, for example. Four extendible legs are adapted to be secured to the arms of a wheelchair. Two of the legs terminate in flat pad mounts which may be attached to and rest upon the upper broad and flat surfaces of wheelchair arms. The other two legs include interchangeable ends, some of which may also include flat pad mounts to be attached to the flat surfaces of such arms, and others of which may include spring-clips that may be snapped over or clamped around a bar with a circular cross section. The flat pads are preferably held in place by straps using "Velcro" hook and loop fasteners. The spring-clips are primarily devices which may be pushed into place around a circumference of a circular pipe. Optionally, a wing nut may supplement the circular clamps to more securely hold them in place.

9 Claims, 5 Drawing Figures

MOUNTS FOR ATTACHMENT OF DEVICES TO WHEELCHAIRS

This invention relates to mounts for attachment of devices to wheelchairs and more particularly to camera mounts, or the like, for wheelchairs.

Many different kinds of devices might be mounted on a tripod-like structure attached to a wheelchair, limited only by the imagaination of the person in the wheelchair. For example, one might consider mounts for binoculars, telescopes, radios, therapeutic devices, games or the like. However, since cameras exemplify most considerations for wheelchair mounted devices of the described type, the remainder of this description will generically refer to camera mounts.

There are two basic styles of wheelchairs. One style has full length arms which supports the occupant's entire arm from the elbows to the tips of the fingers. The other style of wheelchairs have relatively short arms for supporting only the arm region near the elbows, leaving considerable room for freedom of hand movement. Some people prefer one or the other style of wheelchair, while other people may have both styles so that they may select a particular chair which suits their needs at the time when they are using the chair.

It is not possible to predict the nature of any particular person's handicap. Some may have normal dexterity and others may not. Therefore, a person should be able to attach or use the mount with a minimum amount of small muscle coordination.

Accordingly, an object of the invention is to provide new and improved wheelchair mounts, which are somewhat similar to camera tripods. Here, an object is to provide compact camera mounts which may collapse to a relatively small size which can be carried in a wheelchair beside the handicapped person. In this connection, an object is to provide a mount which is usable on either style of wheelchair, and has the capability of switching from one chair to another quickly and easily.

Yet another object of the invention is to provide mounts which may be attached to and detached from wheelchairs quickly and easily by persons having physical handicaps.

In keeping with an aspect of the invention, these and other objects are accomplished by providing a mount having four extendible legs, two of which terminate in flat pads which can be attached to the upper broad and flat surfaces of wheelchair arms. The other two legs include interchangeable ends, some of which may also include flat pad mounts to be attached to the flat surfaces of such arms and others of which may include spring-clips which slip over a bar having a circular cross section. The flat pads are preferably held in place by straps using "Velcro" hook and loop fasteners. The spring-clips may be pushed into place around a circular pipe. A wing nut may supplement the circular clamps to more securely hold them in place.

A preferred embodiment of the invention is shown in the attached drawing, wherein.

Figure 1:
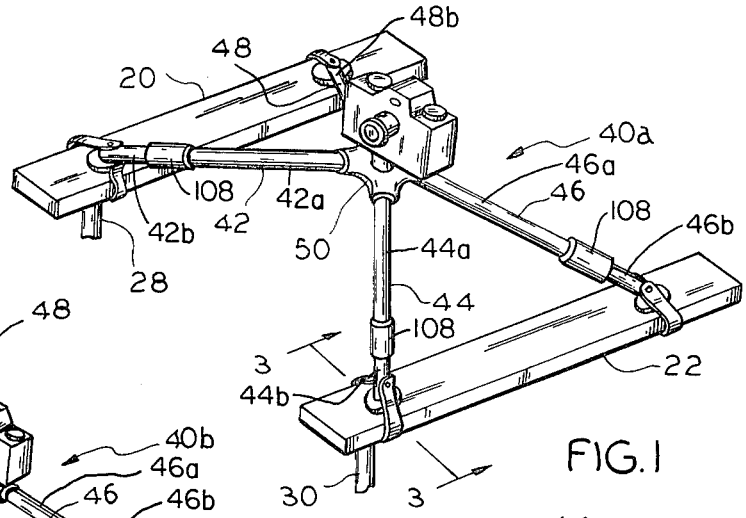
FIG. 1 is a perspective view which shows a pair of arms, a first type of wheelchair, with the inventive flat pad mounts attached thereto.
Figure 2:
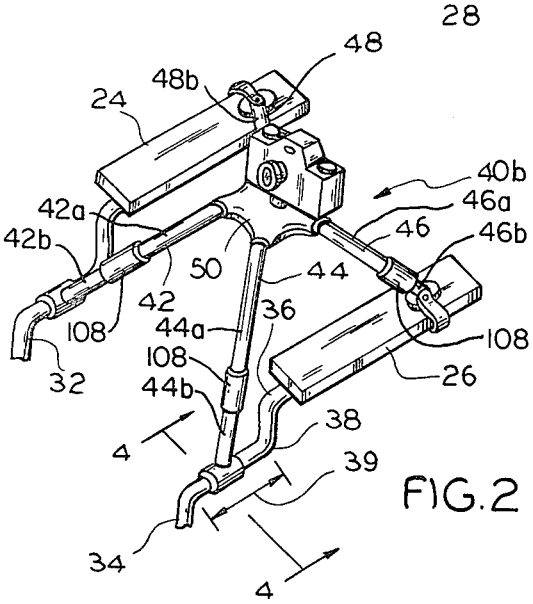
FIG. 2 is a similar perspective view showing the arms on a second type of wheelchair with the inventive mount attached thereto.

There are two conventional types of wheelchair arms, one type being seen in FIG. 1 and the other type being seen in FIG. 2. In FIG. 1, there are two full length arms 20, 22 which extend for approximately the length of the wheelchair occupant's arms. In this embodiment, the occupant's hands rest on the outer ends of arms 20, 22.

In FIG. 2, the wheelchair arms 24, 26 are approximately half as long as arms 20, 22 (FIG. 1), leaving space in front of the arms 24, 26 for the occupant to manipulate his hands.

As with most chairs, the front ends of the wheelchair arms are supported by vertical members which are located near the occupant's knees. This way, if the occupant places his hands on the chair arms and lifts his weight, there is a vertical load bearing member more or less under the occupant's center of gravity. In FIG. 1, these load bearing members 28, 30 are located under the arms 20, 22 themselves, and behind the tips thereof. However, in FIG. 2 the load bearing members 32, 34 have a double bend, as at 36, 38 to provide a horizontal section 39 which is low enough so that it does not interfere with the occupant's hand movement.

For the wheelchair of FIG. 1, the arms 20, 22 have broad and flat upper surfaces which may support all four legs of the inventive mount 40*a*. However, when the inventive mount 40*b* is placed on the other type of wheelchair (FIG. 2), the front two legs are clamped around the horizontal sections 39 of the load bearing members 32, 34, which support the front ends of the arms. This means that two different kinds of fasteners are required for the front two legs of the inventive mounts.

In greater detail, the inventive mount 40 has four telescoping legs 42, 44, 46, 48 which extend from pivotal connections (FIG. 5) at their upper ends to arm fasteners at their lower ends. The upper ends of the legs have pivotal connections which are made to a plate 50. The lower end fasteners may be either flat pads or spring-clips, as shown in either FIG. 3 of FIG. 4, respectively. Legs 42, 44, 46 and 48 comprise outer sleeve portions 42*a*, 44*a*, 46*a* and 48*a* and inner sleeve portions 42*b*, 44*b*, 46*b* and 48*b* which slidably fit within the outer sleeves. Locking device 108 enables the telescoping legs to be locked at predetermined dimensions so that the invention may be adapted for different purposes and various size wheelchairs.

Figure 3:
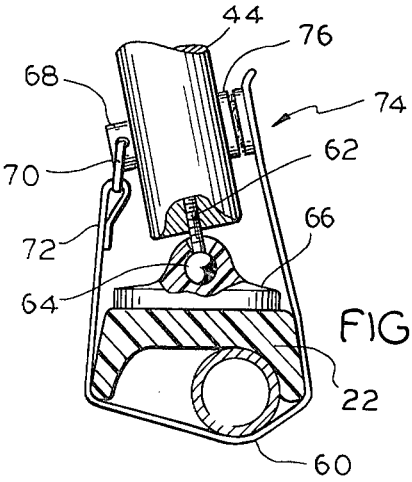
FIG. 3 is a cross section elevation view (taken along Line 3—3 of FIG. 1) which shows a first type of flat pad connector for attachment to a flat arm.

FIG. 3 shows, in cross section, a flat arm 22 securely attached to a supporting tubular frame 60 of the wheelchair. The leg 44 of the mount terminates in a screw 62 ending in a ball 64. The ball rests in a socket of a flat pad 66, which is preferably made of molded plastic. Therefore, as ball 64 swivels in its socket, the flat pad 66 may change its orientation to rest firmly upon the upper surfaces of the chair arm 22.

To secure the flat pad to the wheelchair arm, a screw 68 is threaded horizontally into the tubular leg 44. A loop 70 is pivotally connected to the head of screw 68, to hang in any convenient manner. Thus, a strap 72 may fold over the loop 70 and be attached to itself. Alternatively, the strap 72 may be a molded plastic device which has the loop embedded therein. The opposite end of the strap 72 has one half of a "Velcro" hook and loop connector means 74 attached thereto. The other half 76 of the "Velcro" connector means is mounted on the leg 44.

This way the flat pad 66 may be set on the top of arm 20, the strap 72 pulled around the arm 20 and frame 60 and then held taut, while the "Velcro" hook and loop connector means 74, 76 are pressed together. Removal is equally easy.

It should be noted that little or no small muscle coordination is required to attach or detach the mount. If an occupant of the wheelchair finds it difficult to adjust the telescoping legs, a friend can adjust them once. Thereafter, the small muscle coordination is no longer required in order to attach the mount to or remove it from the wheelchair.

Figure 4:
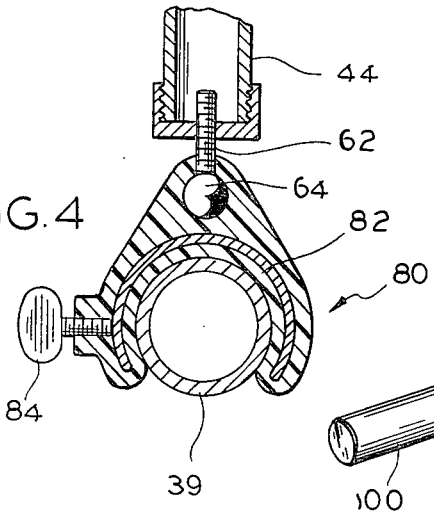
FIG. 4 is a similar cross section (taken along Line 4—4 of FIG. 2) which shows an elevation view of a second type of spring-clip connector for attachment to an arm member having a circular cross section; and, FIG. 5 shows the upper end of the mount which interconnects the four legs of the mount.

In FIG. 4 the spring-clip fastener 80 also cooperates with the screw 62 a ball head 64 embedded in a spherical socket in the top of a molded plastic fastener. A somewhat circular arcuate spring steel clip 82 is integrally molded into the plastic of fastener 80. Therefore, the fastener 80 may be attached to the tubular member 39 simply by pressing it thereover. If desired, nothing further is required to make the attachment to the wheelchair of FIG. 2. However, for those who have no difficulty manipulating it, a wing head bolt 84 may be turned into the fastener 80. This will press the steel clip 82 tightly against the bar 39 and provide greater security. Of course, the wing head of bolt 84 may also be made larger for those who may find that to be more convenient.

If a person has a preference for one type of wheelchair arm, of course, he buys only the kind of arm fastener which fits that wheelchair. However, if the person likes to switch back and forth between wheelchair types, he may purchase the arm fasteners of both FIG. 3 and FIG. 4. One type of arm fastener may be substituted for the other simply by unscrewing the screw 62 of one fastener and replacing it with the other fastener.

The two legs 42, 48 are telescoped to make adjustments for the height differentials between the two types wheelchair arms.

Figure 5:
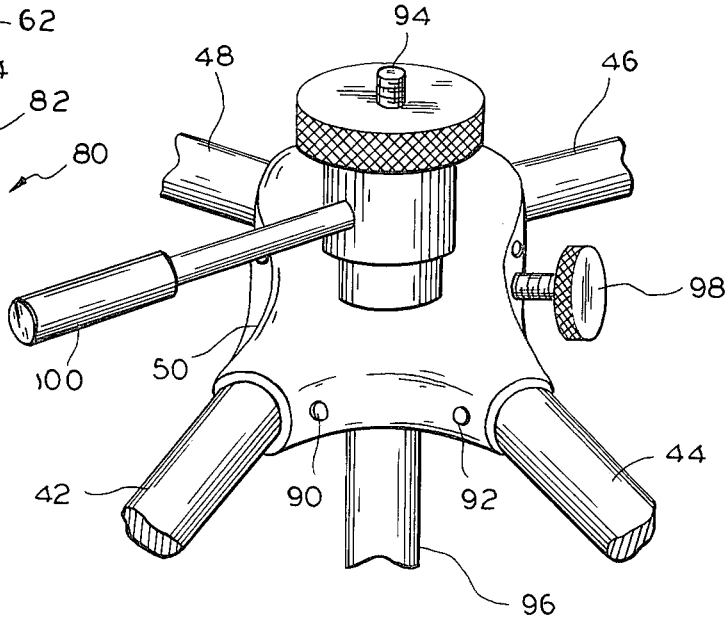

As seen in FIG. 5, the upper ends of the legs come together at a plate 50, where they are pivotally interconnected, as on the pins 90, 92, for example. The plate 50 may be adapted to accept any suitable device 94 for supporting an apparatus such as a known camera head for a conventional tripod. For example, as here shown, a vertical member 96 may slide up and down in plate 50 and be secured in place by a suitable locking screw 98. Likewise, any well known panning head may be used by loosening a handle 100 tipping the head into a desired position, and then once again tightening handle 100. Of course, there are also many other commercially available types of head devices which may also be attached to the top of the inventive mount.

Those who are skilled in the art will readily perceive how to modify the invention. Therefore, the appended claims are to be construed to cover all equivalent structures which fall within the true scope and spirit of the invention.

I claim:

1. A support device for mounting apparatus on a wheelchair comprising a plate member having pivotally attached thereto one end of each of four telescoping legs, means for removably fastening a ball-shaped member to the end of each of said legs opposite said plate, means for removably attaching said legs to said wheelchair containing a socket adapted to receive said ball-shaped member whereby said means can be rotatably and removably mounted on said legs, said means for attaching said legs to said wheelchair comprising a first type which includes a flat pad for resting on a flat surface and strap means connected at a first end to each of said legs with a quick release connector means on a second end of said strap, and a second type which includes an arcuate spring-clip embedded in plastic for snapping over a bar having a generally circular cross section.

2. The support device of claim 1 and means for supporting said apparatus on said plate.

3. The support device of claim 2 wherein said quick release connector means comprises a multiplicity of plastic hooks projecting outwardly toward said leg from said second end of said strap and a multiplicity of plastic loops projecting outwardly from said leg toward said second end of the strap to releaseably engage the plastic hooks on said strap.

4. The support device of claim 2 and means for pressing said arcuate spring-clip firmly against said bar with circular cross section.

5. The mount of claim 2 wherein said apparatus support means has a camera attachment means associated therewith.

6. The support device of claim 2 wherein each of said telescoping legs includes at the end opposite said plate an internal threaded bore and said means for removably fastening said ball-shaped members to each of said legs are threaded to cooperate with the threads of said internal bores.

7. A support device for mounting apparatus on a wheelchair, said support comprising four telescoping legs, means for removably fastening a ball shaped member to the ends of each of said legs, means for removably attaching said legs to said wheel chair containing a socket adapted to receive said ball shaped member and comprising a flat pad for resting on a flat surface and strap means connected at a first end to each of said legs with a quick release connector means on a second end of said strap, whereby said flat pads can be removed from the ends of said legs and replaced by another type of means for attaching said legs to said wheelchair, and means for supporting apparatus pivotally connected to the ends of said four legs opposite said means for attaching said legs to said wheelchair.

8. The support device of claim 7 wherein said means for supporting apparatus includes a camera attachment device.

9. The support device of claim 7 wherein said other type of means for attaching said legs to said wheelchair include an arcuate spring-clip with a threaded device for attaching said spring-clip to a bar with a circular cross section.

* * * * *